US005695414A

United States Patent [19]

Yokota

[11] Patent Number: 5,695,414

[45] Date of Patent: Dec. 9, 1997

[54] COATED GOLF BALL

[75] Inventor: Masatoshi Yokota, Shirakawa, Japan

[73] Assignee: Sumitomo Rubber Industries, Ltd., Hyogo-Ken, Japan

[21] Appl. No.: 656,788

[22] Filed: May 31, 1996

[30] Foreign Application Priority Data

May 31, 1995 [JP] Japan ..... 7-133409

[51] Int. Cl.[6] ..... A63B 37/14

[52] U.S. Cl. ..... 473/384; 473/378

[58] Field of Search ..... 473/378, 384

[56] References Cited

U.S. PATENT DOCUMENTS 4,802,674 2/1989 Kitaoh ..... 473/378 X 5,461,109 10/1995 Blair et al. ..... 473/378 X 5,506,004 4/1996 Maruoka ..... 473/378 X

*Primary Examiner*—George J. Marlo

*Attorney, Agent, or Firm*—Birch, Stewart, Kolasch & Birch, LLP

[57] ABSTRACT

A coated golf ball comprising:

a golf body, a plurality of dimples disposed on the golf ball body, each of the dimples having an edge portion at the periphery of the dimple, and a slope portion connecting the edge portion to a bottom portion of the dimple, and a paint layer formed on the golf ball body and dimples.

The average thickness of the paint layer on the surface of the golf ball body, the edge portion, the slope portion and the bottom portion is 20 to 40% of the depth of the dimple.

6 Claims, 1 Drawing Sheet

COATED GOLF BALL

DEFINITION OF TERMS

The term "coated golf ball" means a golf ball body which is coated with paint. Accordingly, an article which is generally called a "golf ball" by consumers and commercially available belongs to the "coated golf ball" category. In the present specification, the term "golf ball" may sometimes indicate a "coated golf ball" according to common usage.

The term "golf ball body" means a golf ball before it is coated with paint.

FIELD OF THE INVENTION

The present invention relates to a coated golf ball comprising a golf ball body and a paint layer formed on the golf ball body. More particularly, the present invention relates to a coated golf ball which not only shows optimum launch angle and optimum spin amount when hit, but also has excellent protective properties for the golf ball body or marks printed thereon.

BACKGROUND OF THE INVENTION

There are many types of golf balls, such as solid golf balls (e.g. one-piece solid golf balls, two-piece solid golf balls, three-piece solid golf balls and the like) and thread-wound golf balls, and they are all supplied into the market in the form of a coated golf ball having a paint layer provided on the golf ball body. The paint layer is provided for the protection of the surface of the golf ball body or for providing printing thereon, or for maintaining a white glossy appearance for a long period of time. However, there has never been studied the effect the presence of a paint layer has on the flight performance of golf balls.

OBJECTS OF THE INVENTION

The present inventors have studied the effect of a paint layer on the flight performance of golf balls and have found that flight performance (e.g. launch angle or spin amount) is improved by controlling the thickness of the paint layer within a certain range.

SUMMARY OF THE INVENTION

Figure 1:
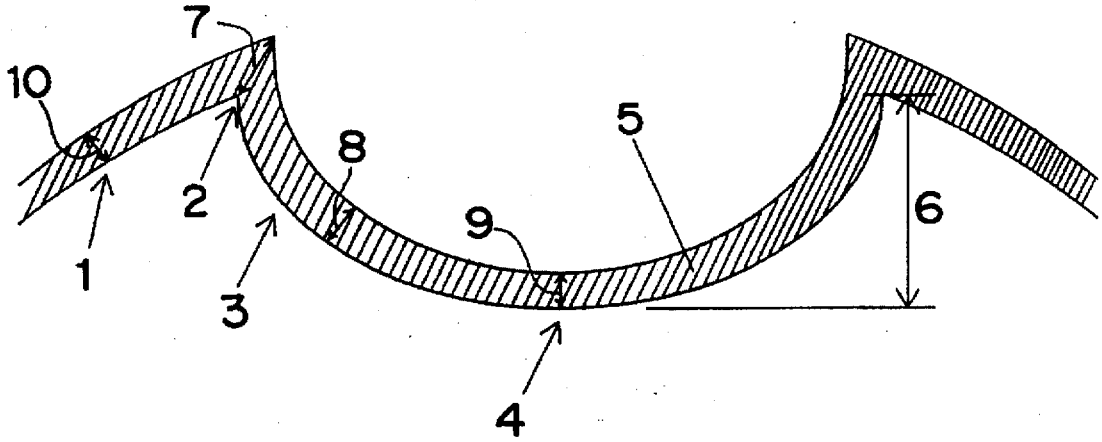
FIG. 1 is a schematic, enlarged cross section illustrating one dimple present on a golf ball body of the present invention.

The present invention provides a coated golf ball comprising:

a golf ball body, a suitable number of dimples provided on the golf ball body, each dimple being composed of an edge which is present at the periphery of the dimple and a slope connecting the edge with the bottom of the dimple, and a paint layer formed on the golf ball body and dimples, wherein the thickness of the paint layer is determined on each of the golf ball body surface, the edge, the slope and the bottom, and the average thicknesses on each portion is within the range of 20 to 40% based on the depth of the dimple.

DETAILED DESCRIPTION OF THE INVENTION

In the present invention, the thickness of the paint layer is to be controlled within a certain range. Locations to determine the thickness of the paint layer disposed on the golf ball body surface include the edge at the periphery of a dimple, the slope connecting the edge portion to the bottom of the dimple, and the bottom of the dimple. These locations are indicated in FIG. 1, where the golf ball body surface is shown by 1, the edge by 2, the slope by 3 and the bottom by 4. In FIG. 1, 5 shows the paint layer. The determination of the thickness of the paint layer is conducted using a microscope. A coated golf ball is cut into halves through the center line of a dimple and the center point of the golf ball body and then its cross section is observed by the microscope to determine the thickness of the paint layer. The thickness of the paint layer is determined by measuring the perpendicular distance from the surface of the paint layer to the golf ball body. For example, if the thickness at the edge is to be determined, the thickness 7 in FIG. 1 is measured. If the thickness at the bottom of the dimple is to be determined, 9 is measured. If the thickness at the slope is to be determined, 8 is measured. Element 10 shows the thickness of the paint layer at the golf ball body surface. In FIG. 1, the edge 2 is shown as an acute angle because it is a schematic view, but actually the edge 2 is more round. In the case of a round edge, the thickness determination is made using the thickness at the summit point of the round edge.

In the present invention, the determination of thickness is conducted on each of the determining points, the golf ball body surface, the edge, the slope and the bottom of the dimple. If necessary, the determination is conducted several times at each point to obtain an average thickness. Then an average thickness of the four determining points is calculated and controlled to 20 to 40%, preferably 20 to 35% of a depth 6 of the dimple. If the average thickness is less than 20% of the depth of the dimple, the golf ball, when hit, exhibits a low launch angle and a high spin amount, which causes a reduction in the flight distance. If it is more than 40%, the launch angle is too high and the spin amount is too small, which causes a drop in the trajectory which reduces the flight distance. In addition, if the average thickness of the paint layer is more than 40% of the depth of the dimple, the paint layer is too thick and almost fills up the dimple. Thus, the technical effect of the dimples (e.g. a buoyancy to the golf ball) cannot be achieved. If the thickness of the paint layer is within the claimed range, the golf ball slips slightly against the golf club when contacted with the golf club because the painted layer is more slippery than the surface of the golf ball body. This slip heightens the launch angle and reduces the spin amount which results in an extension of the flight distance.

According to the present invention, the paint layer preferably has a thickness of 40 to 70 μm, more preferably 40 to 60 μm. This thickness range is one which is generally obtained at the time when coating the paint on the golf ball body. However, since the golf ball body has many dimples, for example 300 to 500 dimples, it may be difficult to form a uniform thickness of the paint layer. Accordingly, if the thickness is actually determined, not every point satisfies the above thickness range. It is therefore preferable that (more than 50% of the) of dimples, particularly more than 80% of the dimples, satisfies the above thickness range.

The dimples formed on the golf ball body generally have a depth of 0.1 mm to 0.3 mm. If the dimples have a depth of less than 0.1 mm, the presence of the dimples does not improve the flight performance of the golf balls. If the depth is more than 0.3 mm, the balls rise higher when hit which reduces the flight distance.

The paint layer preferably has a pencil hardness of B to 2H. The pencil hardness is measured by pushing a pencil against the coating at an angle of 45° to observe whether the coating will be scratched. The pencil hardness is not measured using a coated golf ball, but by measuring a coated panel which is prepared by forming a paint layer on a flat steel substrate. Pencil hardness of less than B gives too much spin to the golf ball, reducing the launch angle and causing a deterioration in the strength of the paint layer. Hardness of more than 2H adversely reduces the spin amount and makes the paint layer too hard, resulting in defects in the paint layer.

The golf ball body can be any type as long as the paint layer satisfies the characteristics of the present invention, but includes solid golf balls, such as one-piece solid golf balls, two-piece solid golf balls, three-pieces solid golf balls and the like; or thread-wound golf balls. In the case of the two-piece solid golf balls, a solid core is prepared from a rubber composition which comprises a base rubber (e.g. high cis-polybutadiene rubber), a peroxide and an additive and then is covered with a thermoplastic resin (e.g. an ionomer resin) to form a two-piece golf ball body. The two-piece golf ball body is generally subjected to a buffing treatment and a pre-treatment for painting. The pre-treatment for painting includes physical treatment, such as sand blast treatment and blushing treatment; chemical treatment, such as plasma treatment, alcohol treatment and chemical coating.

The surface of a golf ball body is generally made of the thermoplastic resin, such as an ionomer resin, as mentioned above, but may be made of balata or hard rubber. Preferred is the ionomer resin because of the presence of free carboxyl groups on the surface which provides good adhesiveness.

The paint employed for coating the golf ball body can be an epoxy type or urethane type, but the urethane type paint is preferred in view of the adhesiveness between the paint layer and the golf ball body. The urethane type paint can be any which has been previously used in golf balls, and includes an active hydrogen containing compound, e.g. a polyester polyol, polyether polyol, etc., and an isocyanate curing agent. Examples of the isocyanate curing agents includes a modified 1,6-hexamethylene diisocyanate, a modified tolylene diisocyanate and the like.

The paint for golf balls generally contains various additives and diluents, in addition to the above mentioned components. Examples of such additives are ultraviolet absorbers, light stabilizers, sealing pigments, fluorescent agents, fluorescent brighteners and the like. The additives are present in an amount of 0.1 to 10% by weight, based on the solid content of the paint. The fluorescent agent or fluorescent brightener includes 2,5-bis [5'-t-butylbenzoxazolyl(2)]thiophene (Ubitex OB available from Chiba Geigy AG), 7-(2h-naphthol-(1,2-d)-triazol-2-yl)-3-phenyl-kusline(Leucopure EMG), a biazoline derivative (available as Whiteflure HCS, PCS and B from Sumitomo Chemical Co., Ltd.) and Hostalux KCB (available from Hechst Japan Co., Ltd.). It may be present in an amount of 0.005 to 1.0% by weight based on the solid content of the paint. The diluent includes alcohols, such as isopropyl alcohol; aromatic hydrocarbons, such as toluene; aliphatic hydrocarbons, such as hexane; esters, such as ethyl acetate; ketones, such as methyl ethyl ketone; and the like. The diluent may be present in an amount of 5 to 50% by weight based on the solid content of the paint.

The paint is coated on the golf ball body by any art-known method, such as air gun coating, electrostatic coating and the like.

EXAMPLES

The present invention will be illustrated by the following Examples which are not to be construed as limiting the present invention.

Example 1 to 2, and Comparative Examples 1 to 2

A solid core was prepared by mixing the following core formulation (I) to form a rubber composition, and then vulcanizing it at 160° C. for 25 minutes. A cover composition was prepared from the following cover formulation (II) and then covered on the solid cover by injection molding to form a two-piece golf ball body having 432 dimples thereon. The golf ball body was subjected to blast treatment to make the surface active. A primer paint for a golf ball was prepared from the primer of the following paint formulation (III) and applied to the golf ball body by an air gun, followed by drying to cure the paint. After printing marks on it, a clear paint was prepared from the paint formulation (III) and applied to the primer-coated golf ball and cured by drying to form a coated golf ball. The thickness of the paint layer was changed as shown in Table 1 by controlling the coating conditions to obtain 4 kinds of coated golfs, two of which are included in the range of the present invention and the other two are for Comparative Examples 1 and 2.

(I) Core Formulation

| Ingredients | Parts by weight |
|---|---|
| BR-18*1 | 100 |
| Zinc acrylate | 30 |
| Zinc oxide | 20 |
| Antioxidant*2 | 0.7 |
| Dicumyl peroxide | 1.5 |

*1Polybutadiene rubber having 96% cis-construction, available from Japan Synthetic Rubber.
*2Available from Yoshitomi Seiyaku K. K. as Yoshinox 425.

(II) Cover Formulation

| Ingredients | Parts by weight |
|---|---|
| Hi-milan #1605*3 | 50 |
| Hi-milan #1706*4 | 50 |

*3Ionomer resin neutralized with Na, available from Mitsui Polychemical Co., Ltd.
*4Ionomer resin neutralized with Zn, available from Mitsui Polychemical Co., Ltd.

(III) Paint Formulation

| | Parts by weight | |
|---|---|---|
| Ingredients | Primer | Clear |
| Urethane resin | 100 | 100 |
| Light stabilizer*5 | 0.2 | — |
| Ultraviolet absorber*6 | 0.1 | — |
| Antioxidant*7 | 0.1 | — |
| Fluorescent brightener*8 | 0.2 | — |

*5Sanal LS770 available from Sankyo Co., Ltd.
*6Tinuvin 900 available from Chiba Geigy AG.
*7Irganox 245 available from Chiba Geigy AG.
*8Ubitex OB available from Chiba Geigy AG.

Pencil hardness of the primer paint was H and that of the clear paint was F.

The resulting golf balls were evaluated with respect to the launch angle, the spin amount, the flight distance (carry) and the durability of the marks printed thereon. The thickness of the paint layer of the coated golf balls was determined at the golf ball body surface, edge, slope and bottom of the dimples shown in FIG. 1 as generally described in the specification. The results are shown in Table 1.

Launch angle: A driver was attached to a swing robot available from True Temper Co and a golf ball was hit thereby at a head speed of 40 m/s. The launch angle was obtained by a photograph of the hit golf ball.

Spin amount: The spin amount was measured by hitting with a driver at a head speed of 40 m/second, using a swing robot manufactured by True Temper Co., and then taking a photograph of the hit golf ball.

Flight distance (carry): The flight distance was measured by hitting with a No. 1 wood club at a head speed of 40 m/second, using a swing robot manufactured by True Temper Co. The distance was expressed by carry which is a distance from the hit point to the point where the hit ball landed firstly on the ground.

Durability of marks: A golf ball was hit 50 times by a driver equipped with a swing robot manufactured by True Temper Co. at a head speed of 40 m/s. After 50 times hitting, the defects of marks were observed.

Good: Almost no defects of the marks are observed.

Poor: Many defects on the marks are observed.

TABLE 1

| | Examples | | Comparative Examples | |
|---|---|---|---|---|
| | 1 | 2 | 1 | 2 |
| Paint layer thickness (μm) | | | | |
| Golf ball body surface | 44 | 55 | 30 | 75 |
| Edge | 40 | 47 | 18 | 60 |
| Slope | 46 | 52 | 31 | 68 |
| Bottom | 41 | 48 | 25 | 72 |
| Average (M) | 42.8 | 50.5 | 26.0 | 68.8 |
| (Average/Dimple depth) × 100(%) | 28.5 | 33.7 | 17.3 | 45.9 |
| Launch angle (°) | 12.1 | 12.3 | 11.3 | 12.8 |
| Spin amount (rpm) | 2,730 | 2,650 | 2,840 | 2,580 |
| Flight distance (yards) | 198.4 | 199.1 | 196.1 | 196.2 |
| Durability of marks | Good | Good | Poor | Good |

As is apparent from the above results, the golf ball, of which the paint layer satisfies the claimed range, shows suitable launch angle and spin amount and keeps long flight distance and durability of marks. The golf ball of Comparative Example 1 has a thin paint layer which enhances spin amount, but reduces launch angle and flight distance. It also show very poor durability of marks. The golf ball of Comparative Example 2 has a thicker paint layer which enhances launch angle but reduces spin amount and flight distance. It, however, shows good durability of marks, because they are covered with the thick paint layer.

What is claimed is:

1. A coated golf ball comprising:

a golf body, a plurality of dimples disposed on said golf ball body, each of said dimples having an edge portion at the periphery of the dimple, and a slope portion connecting the edge portion to a bottom portion of the dimple, and a paint layer formed on the golf ball body and dimples, wherein the average thickness of the paint layer on the surface of the golf ball body, the edge portion, the slope portion and the bottom portion is 20 to 40% of the depth of the dimple.

2. The coated golf ball according to claim 1 wherein the paint layer has a thickness of 40 to 70 μm.

3. The coated golf ball according to claim 1 wherein the paint layer has a pencil hardness of B to 2H.

4. The coated golf ball according to claim 1 wherein said paint layer is composed of a pigmented primer paint layer and a clear paint layer formed on the primer paint layer.

5. The coated golf ball according to claim 1, wherein the dimples have a depth of 0.1 mm to 0.3 mm.

6. The coated golf ball according to claim 1, wherein more than 80% of the dimples satisfy the thickness range.

* * * * *